US008844328B2

(12) United States Patent
Loss

(10) Patent No.: US 8,844,328 B2
(45) Date of Patent: Sep. 30, 2014

(54) DOOR OF A HOUSEHOLD ELECTRICAL APPLIANCE

(75) Inventor: Aurimar Antonio Bassanezi Loss, Timbo (BR)

(73) Assignee: Mueller Eletrodomesticos S/A, Timbo (BR)

( * ) Notice: Subject to any disclaimer, the term of this patent is extended or adjusted under 35 U.S.C. 154(b) by 13 days.

(21) Appl. No.: 13/474,636

(22) Filed: May 17, 2012
(Under 37 CFR 1.47)

(65) Prior Publication Data

US 2013/0002113 A1 Jan. 3, 2013

Related U.S. Application Data

(63) Continuation of application No. PCT/BR2010/000399, filed on Nov. 24, 2010.

(30) Foreign Application Priority Data

Nov. 24, 2009 (BR) ..... 0904932

(51) Int. Cl.
*D06F 39/14* (2006.01)
*D06F 58/04* (2006.01)
*D06F 37/28* (2006.01)

(52) U.S. Cl.
CPC ..... *D06F 39/14* (2013.01); *D06F 58/04* (2013.01); *D06F 37/28* (2013.01)
USPC ..... 68/196; 312/326

(58) Field of Classification Search
USPC ..... 68/196; 34/88, 108, 603; 312/228, 326
See application file for complete search history.

(56) References Cited

U.S. PATENT DOCUMENTS

| | | | | |
|---|---|---|---|---|
| 7,320,186 | B2 * | 1/2008 | Schone | 34/603 |
| 7,997,105 | B2 * | 8/2011 | Hill et al. | 68/196 |
| 8,161,777 | B2 | 4/2012 | Loss | |
| 2005/0262887 | A1 * | 12/2005 | Kim et al. | 68/196 |
| 2006/0265899 | A1 * | 11/2006 | Renzo | 34/603 |
| 2007/0051012 | A1 * | 3/2007 | Schoene | 34/603 |
| 2008/0302141 | A1 * | 12/2008 | Chung | 68/196 |
| 2011/0023315 | A1 * | 2/2011 | Schone | 34/88 |
| 2011/0023316 | A1 * | 2/2011 | Schone | 34/88 |

OTHER PUBLICATIONS

Application No. P100104331; Office action from Argentina Patent Office Apr. 15, 2011 and response thereto; All in Spanish and English. PCT/BR2010/000399 ; Nov. 24, 2010; WO2011/063486; Nov. 24, 2011; please see www.wipo.int for all documentations, including ISR.

* cited by examiner

*Primary Examiner* — Joseph L Perrin
(74) *Attorney, Agent, or Firm* — Peter Ganjian; Patent Law Agency, LLC

(57) ABSTRACT

An improvement in the door of a household electrical appliance which comprises a bipartite rotary door containing an outer door (10), an intermediary door (20) disposed behind the outer door (10), and an inner rotary door (30). In the second embodiment, the improvement in the door of a household electrical appliance comprises a bipartite tilt door containing an outer door (10), an intermediary tilt door (60) disposed between the outer door (10) and am inner door (70).

3 Claims, 6 Drawing Sheets

DOOR OF A HOUSEHOLD ELECTRICAL APPLIANCE

CROSS-REFERENCE TO RELATED APPLICATIONS

This Application is a CONTINUATION of a co-pending International Patent Application No. PCT/BR2010/000399 with an international filing date of 24 Nov. 2010 that designated the United States of America, which claims the benefit of priority of the Federative Republic of Brazil Patent Application No. PI 0904932-0, with a filing date of 24 Nov. 2009, the entire disclosures of all Applications is expressly incorporated by reference in their entirety herein.

BACKGROUND OF THE INVENTION

1. Field of the Invention

This invention relates to an improvement in the door of a household electrical appliance. More particularly, it relates to a bipartite door applied to such household electrical appliances as washing machines, clothes dryers or centrifuges, said bipartite door being preferably applied to front-loading washing machines.

2. Description of Related Art

Household electrical appliances, in particular, washing machines, clothes dryers, and centrifuges, usually comprise a lid on the front surface which allows access to the washing tub to load laundry. However, considering the limited physical space in current buildings and following the tendency of the market of household electrical appliances, these machines have been available with a door on their front surface and are known as "front-load" washing machines.

There is however an inconvenience in the machines with front load doors which cannot be opened to add laundry, while they are in operation, as water, when at its limit, may overflow when they are opened.

Some solutions known in the art disclose automatic systems for controlling water in the wash tub allowing the door to be opened while the machine is in operation. This solution, albeit efficient, increases the cost of the machine and wastes more water and soap. Thus, a bipartite door that allows additional laundry to be loaded into the wash tub while the washing machine is in operation without water overflowing and laundry falling out of the wash tub is necessary, such an improvement in the door of a household electrical appliance being disclosed and claimed herein.

BRIEF SUMMARY OF THE INVENTION

In general, this invention concerns an improvement in the door of a household electrical appliance that comprises a bipartite rotary door which contains an outer door, an intermediary door disposed behind the outer door, and an inner rotary door engaged in the intermediary door.

In the second embodiment, the improvement in the door of a household electrical appliance comprises a bipartite tilt door that contains an outer door, and intermediary tilt door disposed between the outer door and an inner door.

The improvement in the door of a household electrical appliance provides a bipartite door which allows the door to be opened at any time during the operation of the machine in order to add laundry.

The improvement in the door of a household electrical appliance allows the door to be partially or fully opened.

The improvement in the door of a household electrical appliance provides a bipartite door which allows a locking mechanism to be added in order to prevent access to the inside of the household electrical appliance.

The improvement in the door of a household electrical appliance comprises a hinge arranged on the lid itself.

The improvement in the door of a household electrical appliance allows the door to be opened by rotating or tilting it.

DETAILED DESCRIPTION OF THE INVENTION

Figure 1:
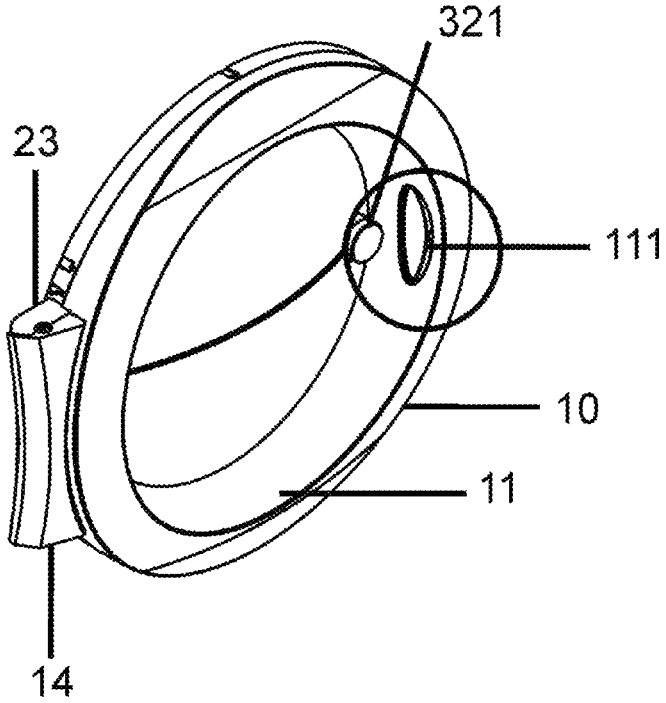
FIG. 1 is a perspective view of the door.
Figure 2:
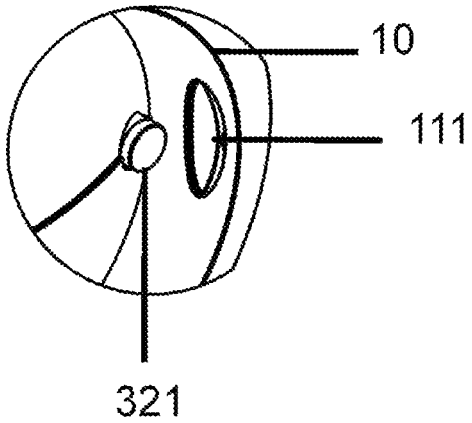
FIG. 2 is a detailed view of the catch portion disposed on the external frame of the door.
Figure 3:
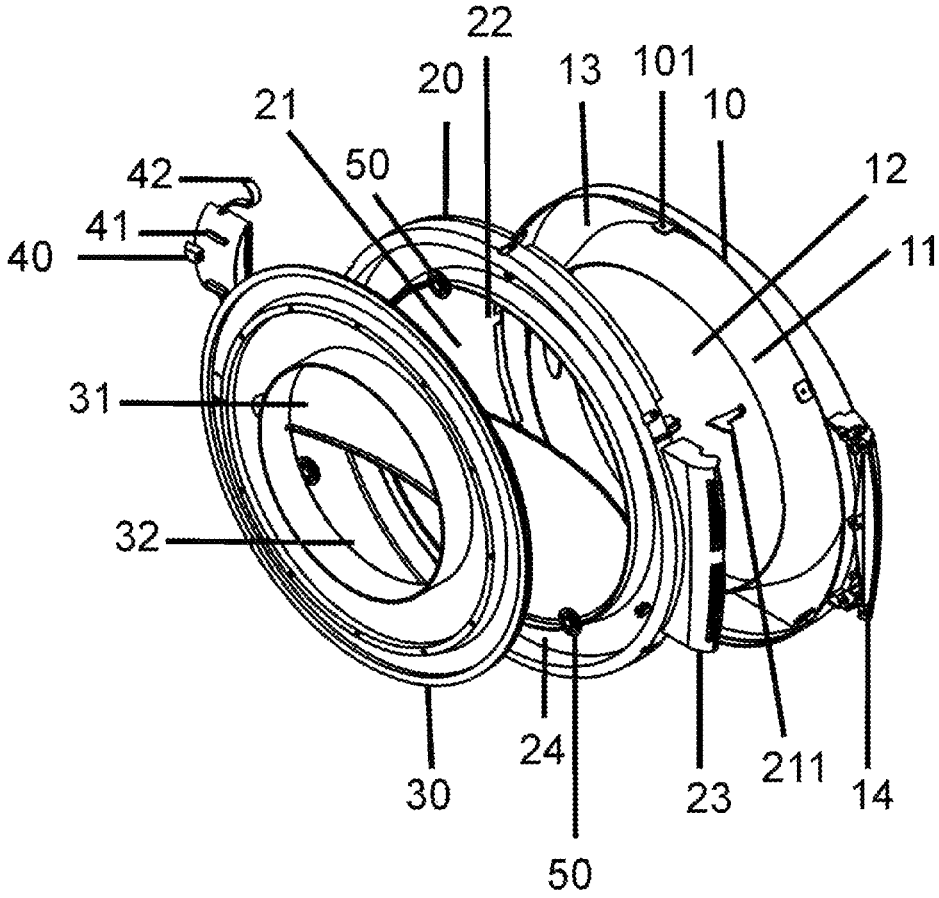
FIG. 3 is an exploded view of the door showing grooves for engaging the frames.
Figure 4:
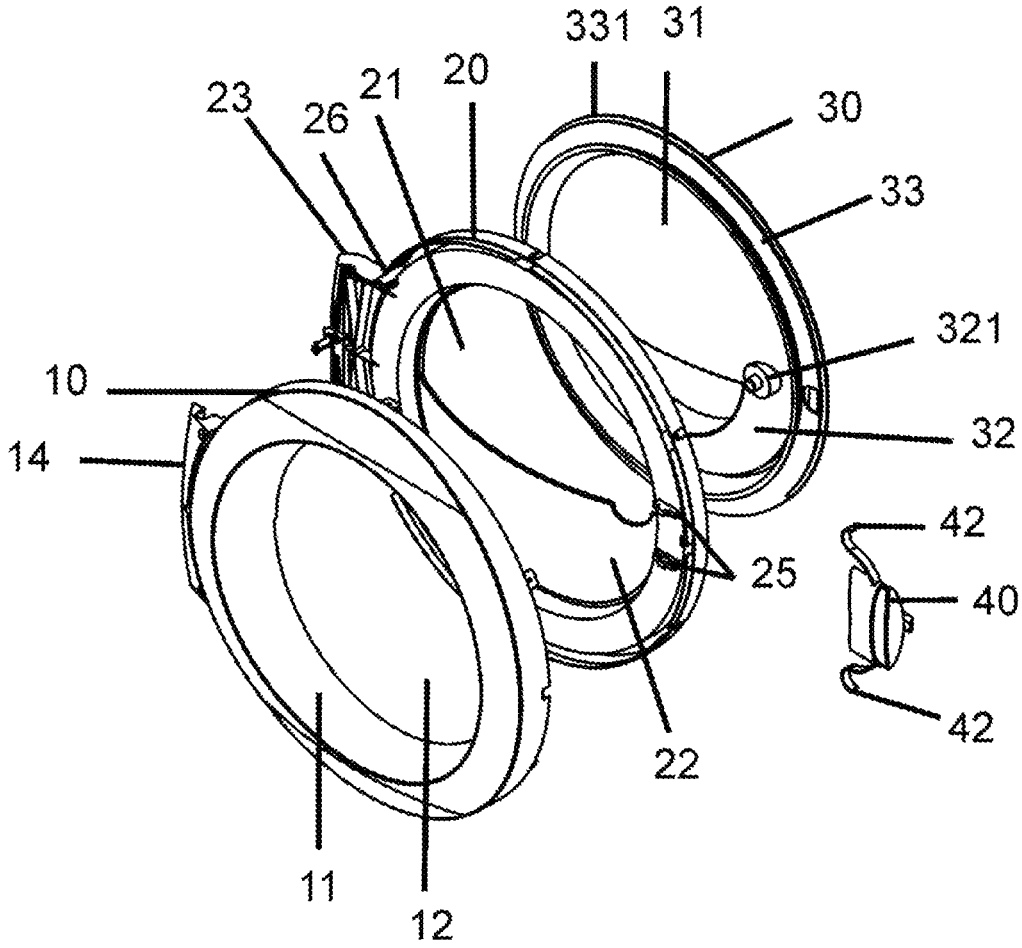
FIG. 4 is an exploded view of the door.
Figure 5:
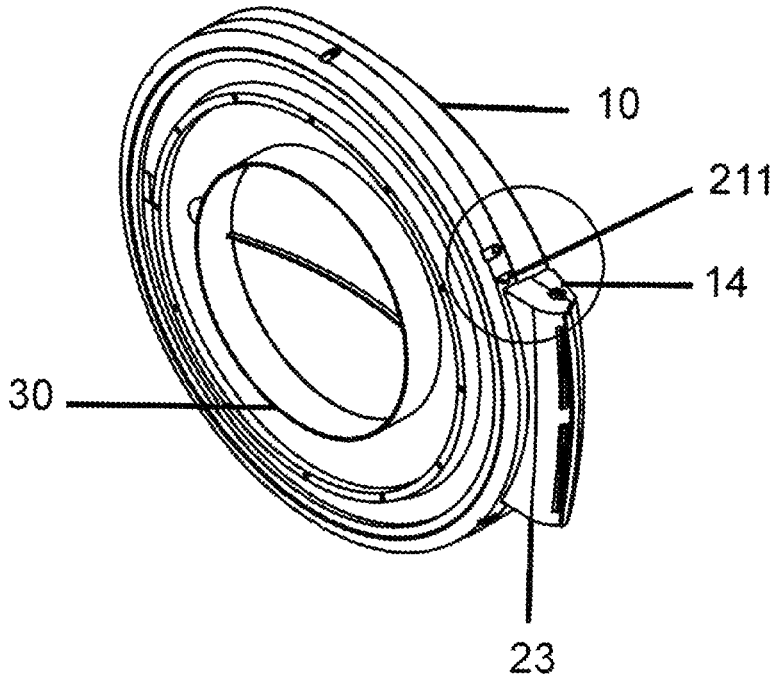
FIG. 5 is a perspective view of the door showing the back surface.
Figure 6:
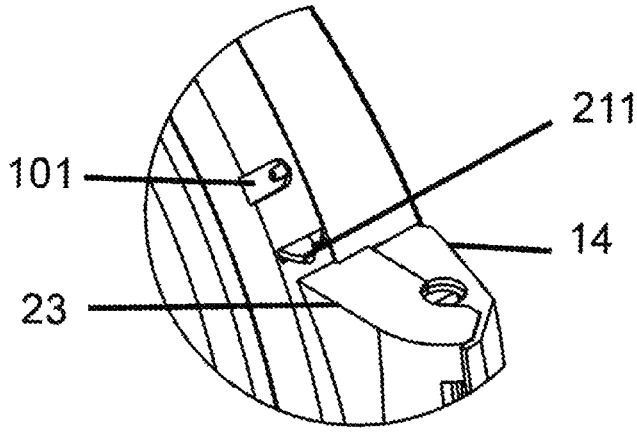
FIG. 6 is a detailed view of the manner the door is attached to the housing of the household electrical appliance.
Figure 7A:
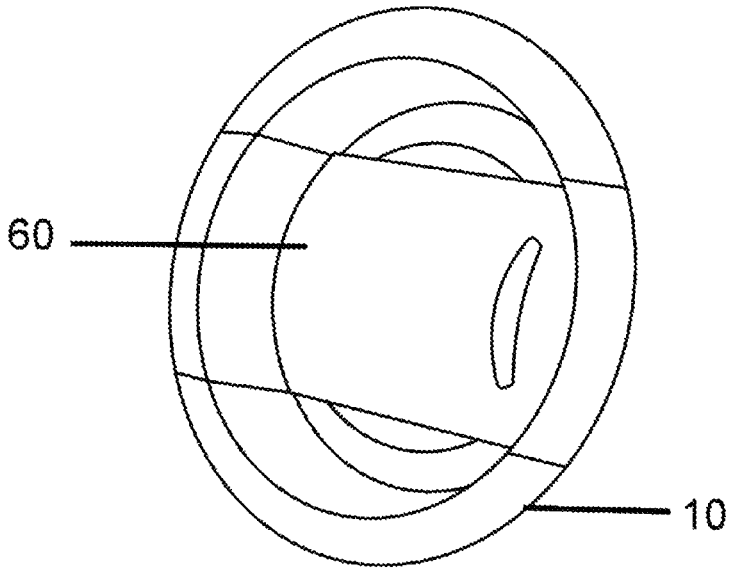
FIG. 7 is a perspective view of the tilt door described in the second embodiment, FIG. 7A showing the closed door, FIG. 7B showing the open door, and FIG. 7C being an exploded view.
Figure 7B:
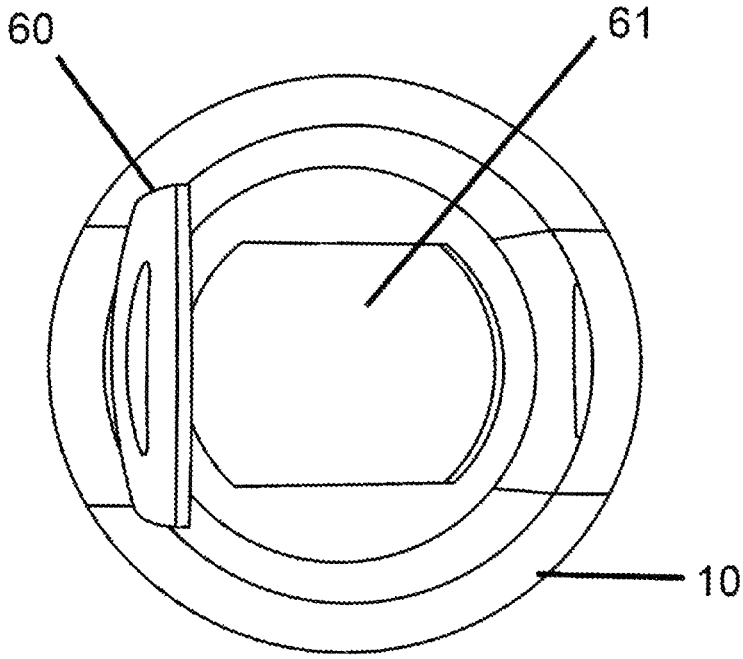
Figure 7C:
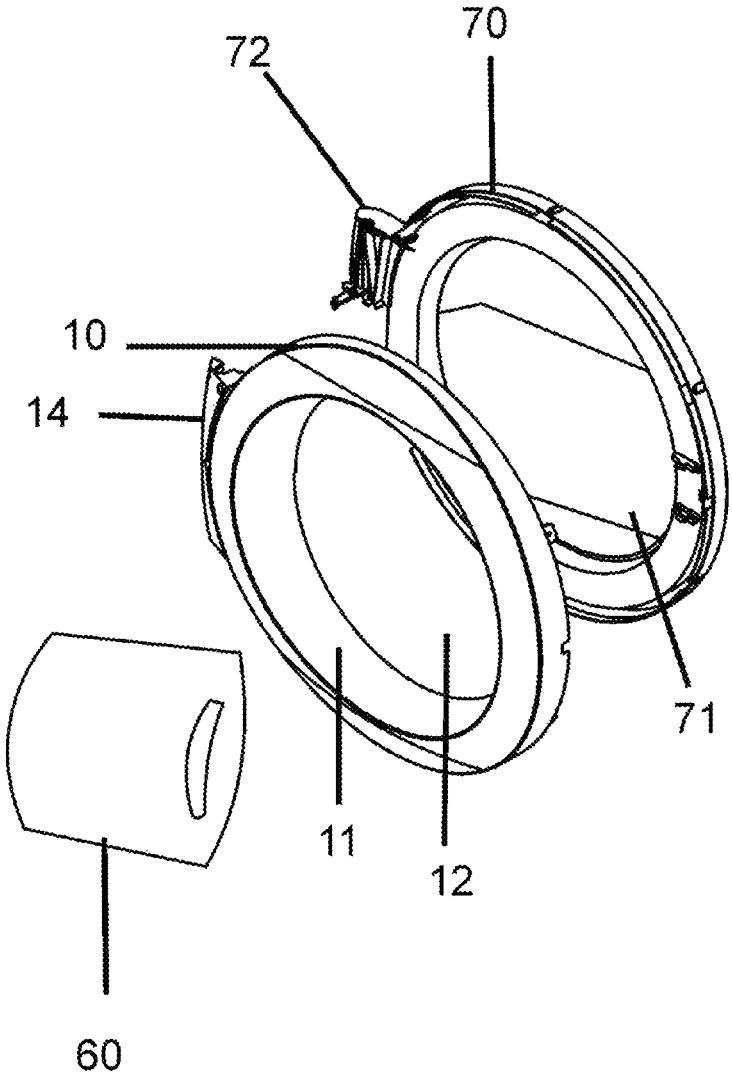

The improvement in the door of a household electric appliance, subject matter hereof, discloses a bipartite rotary door in the first embodiment and a bipartite tilt door in the second embodiment.

In the first embodiment, the improvement in the door of a household electrical appliance comprises an outer door (10), an intermediary door (20) disposed behind the outer door (10) and an inner rotary door (30) engaged in the intermediary door (20).

The outer door (10) comprises a frame fitted with a rim (11) converging to the open central area (12), a depression portion (111) being disposed on the surrounding rim (11) with the catch function and providing access to the locking mechanism (40), thus preventing said outer door (10) from being opened.

From the rim of the frame of the outer door project tabs fitted with through holes (101) and a prolongation fitted with a groove (14).

A channel (13) for engaging the intermediary door (20) is disposed on the back surface of the outer door (10), the intermediary door (20) being affixed to the outer door (10) by disposing the affixing means in the trough hole of the tabs (101).

The intermediary door (20) comprises a frame with 5 a central area fitted with an open area disposed in the upper medium portion (21) coinciding with the open central region (12) of the outer door (10), and a fixed area (22) in the lower medium portion, said intermediary door (20) being disposed behind the outer door (10).

A prolongation (23) is disposed on the frame of the intermediary door (20) and coincides with the prolongation (14) disposed on the outer door (10), said prolongations (14) and (23) being joined together by the affixing means, thus forming a hinge.

A channel (24) is disposed on the back surface of the frame of the intermediary door (20) for engaging the inner rotary door (30).

The grooves (25) are disposed on the surface of the frame of the intermediary door (20).

The inner rotary door (30) comprises a frame fitted with a central area with an open portion (32) and a closed portion (31) adjacent to the open portion (32), said open portion (32) aligned with the open portion (21) of the intermediary door (20) as the tub is being loaded. When the household electrical appliance is in operation, the open portion (32) is aligned with the fixed portion (22) of the intermediary door and the closed portion (31) aligned with the fixed portion (22), thus fully closing the opening.

The closed portion (31) comprises a means suitable for disposing a catch or handle portion (321).

The locking mechanism of the door comprises a structure with a locking component (40), having, on its surface, an arrangement of grooves (41) with a projection of a pair of semi-flexible divergently arranged arms (42), said arms (42) having a spring effect and resting on the back surface of the frame of the outer door (10). The grooves (41) disposed in the locking mechanism (40) are fitted into the grooves (25) disposed on the intermediary door (20). The user activates the lock (40) positioned in the recess (111) disposed on the outer door (10) in such a manner that the arms (42) stretch and the locking component shifts, allowing the external door (10) to be opened.

A tab (211) which fits into the recess (26) disposed next to the prolongation (23) is affixed to the intermediary door (20), said tab (211) which turns on or off a microswitch (not shown) disposed in the structure of the household electrical appliance, thus actuating or stopping the motor.

The inner rotary door (30) comprises, on the outer rim of the frame (33), a recess (331) that forms a cam. When the inner rotary door (30) rotates, the cam (331) acts on the tab (211) which turns off the microswitch and the motor of the household electrical appliance. When the inner door (30) is open, the tab (211) turns the microswitch off, stopping the motor of the machine.

Optionally, a locking mechanism (not shown) is included into the catch portion (321).

Optionally, at least, one supporting component (50), either fixed or rotating, is affixed onto the back surface of the intermediary door (20), said supporting component (50) shifting on the frame (33) of the inner door (30), thus making the rotation of said inner door (30) easier and preventing it from sliding laterally.

In the second embodiment, the improvement in the door of a household electrical appliance comprises a bipartite tilt door that contains an outer door (10), a tilt intermediary door (60) positioned between the outer door (10) and an inner door (70).

The outer door (10) comprises a frame fitted with a rim (11) converging to an open central region (12). From the rim of the frame projects a prolongation fitted with a groove (14).

An inner door (70) which comprises a frame with a central area fitted with an open central portion (71) is positioned on the back surface of the outer door (10). A prolongation (72) coinciding with the prolongation (14) disposed on the outer door (10) is disposed on the frame of the inner door (70), said prolongations (14) and (72) joined together by the affixing means, thus forming a hinge for the whole set formed by the intermediary doors (60), outer door (10), and inner door (70) or only for opening the intermediary door (60).

What is claimed is:

1. A household electrical appliance comprising:

a) an outer door (10) that contains a frame fitted with a rim (11) converging to an open central area (12), a recess portion (111) with a locking mechanism (40) being arranged on said surrounding rim (11), where tabs fitted with through holes (101) and a prolongation fitted with a groove (14) project from the rim of the frame, and a channel (13) being arranged on the back surface of the outer door (10);

b) an intermediary door (20) positioned behind the outer door (10) and fitted into the channel (13) disposed on the outer door (10) and fitted into the through hole of the tabs (101), said intermediary door (20) comprising a frame with a central area fitted with an open portion disposed in the upper medium portion (21) coinciding with the open central area (12) of the outer door (10), and a fixed portion (22) in the lower medium portion, a prolongation (23) coinciding with the prolongation (14) disposed on the outer door (10) arranged on the intermediary door (20), said prolongations (14) and (23) joined together by the affixing means, and the back surface of the frame of the intermediary door (20) fitted with a channel (24) for engaging the inner rotary door (30) and the surface of the frame with grooves (25), said intermediary door (20) comprising a tab (211) adjacent to the prolongation (23), which is fitted into a recess (26);

c) an inner rotary door (30) fitted into the channel (24) of the intermediary door (20), said inner door (30) comprising a frame fitted with a central area with an open portion (32) and a closed portion (31) adjacent to the open portion (32) and containing a catch or handle portion (321), said inner rotary door (30) comprising a recess (331) on the outer rim of the frame (33), which acts on the tab (211) of the household electrical appliance.

2. The household electrical appliance as in claim 1, wherein the locking mechanism (40) comprises a structure that contains a set of grooves (41) on the surface, with a pair of semiflexible divergently arranged arms (42) projecting from it, said arms (42) having a spring effect and resting on the back surface of the frame of the outer door (10), said groves (41) fitted into the grooves (25) disposed on the intermediary door (20).

3. A household electrical appliance as in claim 1, wherein the back surface of the intermediary door (20) comprises, at least, one support component (50), either fixed or rolling, said support component (50) sliding on the frame (33) of the inner door (30).

* * * * *